US006332711B1

(12) United States Patent
Inuzuka et al.

(10) Patent No.: US 6,332,711 B1
(45) **Date of Patent: *Dec. 25, 2001**

(54) GUSSETED BAG FOR MEDICINAL OR MEDICAL PURPOSES FORMED OF A PLASTIC FILM LAMINATE COMPOSED OF A PLURALITY OF LAYERS

(75) Inventors: Takeshi Inuzuka, Nerima-ku; Susumu Niwa, Iruma-gun; Takayuki Kotani, Shiki, all of (JP)

(73) Assignee: Hosokawa Yoko Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/238,592

(22) Filed: Jan. 28, 1999

(30) Foreign Application Priority Data

Feb. 2, 1998 (JP) ..... 10-020942

(51) Int. Cl.[7] ..... B65D 33/10

(52) U.S. Cl. ..... 383/9; 383/104; 383/109; 383/120

(58) Field of Search ..... 383/9, 104, 120–122, 383/109

(56) References Cited

U.S. PATENT DOCUMENTS

| | | | | |
|---|---|---|---|---|
| 2,799,314 | * | 7/1957 | Dreyer et al. | 383/9 X |
| 3,119,548 | * | 1/1964 | Cook et al. | 383/121 |
| 3,199,437 | * | 8/1965 | Nelsen | 383/9 X |
| 3,528,600 | * | 9/1970 | White | 383/9 |
| 4,363,841 | | 12/1982 | Snow . | |
| 4,450,581 | * | 5/1984 | Hirata | 383/104 X |
| 4,717,262 | * | 1/1988 | Roen et al. | 383/104 X |
| 4,761,080 | | 8/1988 | Schirmer . | |
| 4,813,210 | * | 3/1989 | Masuda et al. . | |
| 4,846,586 | * | 7/1989 | Bruno | 383/9 |
| 5,219,220 | * | 6/1993 | Kucera et al. | 383/131 X |
| 5,250,334 | * | 10/1993 | Lutterotti . | |
| 5,288,531 | * | 2/1994 | Falla et al. | 428/35.2 |
| 5,356,069 | * | 10/1994 | Bochet et al. | 383/104 X |
| 5,375,930 | * | 12/1994 | Tani | 383/104 X |
| 5,587,247 | * | 12/1996 | Kubo et al. . | |
| 5,631,328 | * | 5/1997 | Wang et al. . | |
| 5,741,861 | * | 4/1998 | Yamamoto et al. . | |
| 5,755,514 | * | 5/1998 | Bear-Bartelt | 383/104 |
| 5,908,245 | * | 6/1999 | Bost et al. | 383/9 |
| 5,913,999 | * | 6/1999 | Hayashida et al. | 156/272.2 |
| 6,092,933 | * | 7/2000 | Treu | 383/122 X |
| 6,126,315 | * | 10/2000 | Ichikawa et al. | 383/120 X |

FOREIGN PATENT DOCUMENTS

| | | | | |
|---|---|---|---|---|
| 2752489 | * | 5/1979 | (DE) | 383/9 |
| 0183512 | | 6/1986 | (EP) . | |
| 0377121 | | 7/1990 | (EP) . | |
| 2665687 | * | 2/1992 | (FR) | 383/9 |
| 2672033 | | 7/1992 | (FR) . | |
| 6122457 | * | 5/1994 | (JP) | 383/104 |
| WO 93/15959 | | 8/1993 | (WO) . | |

* cited by examiner

*Primary Examiner*—Allan N. Shoap
*Assistant Examiner*—Robin A. Hylton
(74) *Attorney, Agent, or Firm*—Parkhurst & Wendel., L.L.P.

(57) ABSTRACT

A gusseted bag for medicinal or medical purposes comprises a gusseted bag body formed of a plastic film into a hollow shape; and a sealed portion formed at a bottom of the gusseted bag body. The plastic film is a laminate composed of a plurality of layers. The innermost layer of the plurality of layers essentially consists of polyethylene.

7 Claims, 6 Drawing Sheets

GUSSETED BAG FOR MEDICINAL OR MEDICAL PURPOSES FORMED OF A PLASTIC FILM LAMINATE COMPOSED OF A PLURALITY OF LAYERS

BACKGROUND OF THE INVENTION

1. Field of the Invention

The present invention relates to a gusseted bag for medicinal or medical purposes that can be applied to a disposable sterilized container, which is subjected to no rinsing or sterilizing treatment for reiteration use, thus permitting use without validation.

2. Description of the Related Art

There has conventionally been used a drum can or box-shaped container made of stainless steel as a container for receiving intermediate products for pharmaceuticals. The drum can or box-shaped container, which has already been used for the intended use, must be subjected to a rinsing treatment for reiteration use to clean the inside of the drum can or box-shaped container. The drum can has for example the diameter of 50 cm and the height of 2 m and the box-shaped container has for example the dimensions of 1 m×1 m×1 m. The rinsing treatment of the inside of the drum can or box-shaped container however requires a great deal of labor and much time. In addition, there may occur problems of cross contamination and validation requires a long period of time and much cost in view of such problems of the cross contamination. As a result, there may be nothing for it but to dispose of the used drum can or box-shaped container.

There is, on the other hand, a demand that waste of resources should be avoided through reiteration use of the drum can or box-shaped container made of stainless steel. In reply to such a demand, there has been proposed a technical measures of placing an inner bag formed of polyethylene film in the drum can or box-shaped container made of stainless steel so that intermediate products for pharmaceuticals can be received in the inner bag and the used inner bag can be disposed after the completion of the intended use, thus permitting reiteration use of the drum can or box-shaped container made of stainless steel.

In general, a polyethylene film contains additives such as slipping agent, stabilizer, filler and the like. However, these additives should not be contained in a film for medicinal or medical purposes in view of medicinal or medical regulation. Therefore, such a film has a relatively small strength. In addition, the inner bag formed of the above-mentioned polyethylene film, which is to be placed in the drum can or box-shaped container is manufactured by heat-sealing the bottom portion of a tubular body formed of the polyethylene film under a collapsed condition, or by heat-sealing three portions, i.e., the both side portions and the bottom portion of a pair of polyethylene films placed on each other. The thus manufactured inner bag has no gusset, and the heat-sealed bottom portion thereof cannot accordingly be brought into close contact with the inner surface and the bottom surface of the drum can or box-shaped container, thus leading to a possible occurrence of breakage of the inner bag placed in the drum can or box-shaped container due to influences with respect to medicinal processes and vibration caused by transportation.

The other inner bag formed of polypropylene has also conventionally been proposed. The other inner bag mentioned above contains the same additives as described above, and is relatively brittle and has a poor impact resistance at a low temperature.

SUMMARY OF THE INVENTION

An object of the present invention, which was made in order to solve the above-described problems is therefore to provide a gusseted bag for medicinal or medical purposes, which permits prevention of breakage due to medicinal processes and vibration caused by transportation, and can be used as a disposable sterilized container without validation. In the present invention, when a film excellent in a gas-barrier property is used as an intermediate layer, both surfaces of which are to be laminated with other layers, respectively, it is possible to ensure a safely and stably stored condition of contents received in the gusseted bag.

In order to attain the aforementioned object, a gusseted bag for medicinal or medical purposes of the present invention comprises:

a gusseted bag body formed of a plastic film into a hollow shape; and a scaled portion formed at a bottom of said gusseted bag body;

wherein:

said plastic film is a laminate composed of a plurality of layers; and an innermost layer of said plurality of layers essentially consists of polyethylene.

The above-mentioned structure permits achievement of a sufficient close contact condition of the bottom of the gusseted bag with the inner surface of the bottom of the drum can or box-shaped container and prevention of occurrence of breakage of the gusseted bag even under the influence of medicinal processes and vibration caused by transportation. In the present invention, when a film excellent in a gas-barrier property is used as an intermediate layer, both surfaces of which are to be laminated with other layers, respectively, a safely and stably stored condition of contents received in the gusseted bag can be ensured.

The above-mentioned polyethylene may have a density within a range of from 0.910 to 0.919.

The above-mentioned sealed portion may be formed by heat-sealing the bottom of the gusseted bag body in a K-shaped form in a plan of the gusseted bag body under a collapsed condition thereof so as to form two flap portions corresponding to corner portions of the gusseted bag body, and cutting the two flap portions.

The above-mentioned gusseted bag body may have on an upper portion thereof at least one hole for hanging the gusseted bag.

DETAILED DESCRIPTION OF THE PREFERRED EMBODIMENTS

Now, an embodiment of a gusseted bag for medicinal or medical purposes of the present invention will be described in detail below with reference to the accompanying drawings.

Figure 1:
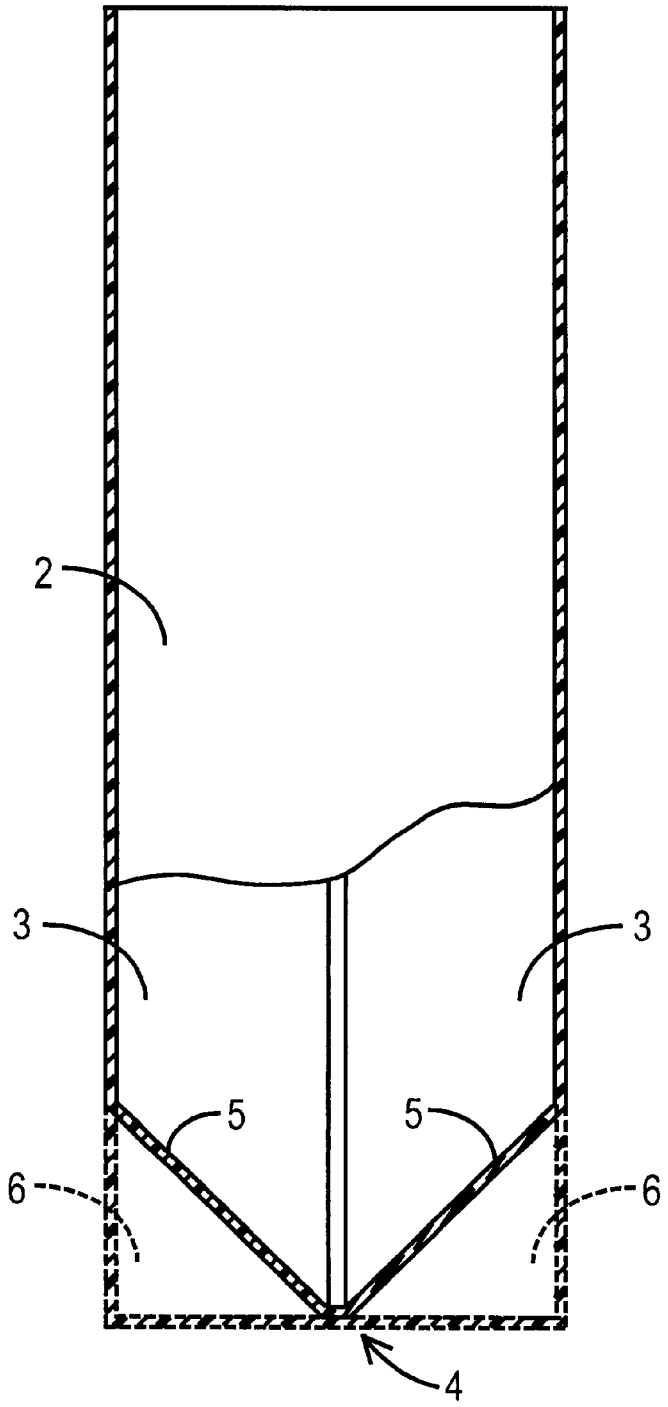
FIG. 1 is a plan view illustrating a gusseted bag, a part of which is broken, for medicinal or medical purposes of the present invention.
Figure 2:
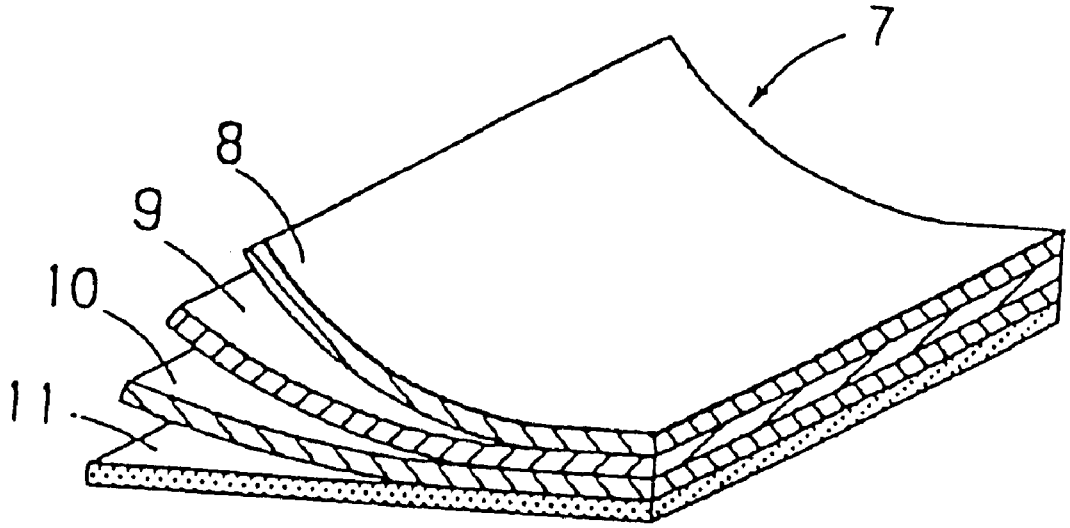
FIG. 2 is a partial perspective view illustrating a laminate for forming the gusseted bag for medicinal or medical purposes of the present invention.
Figure 3:
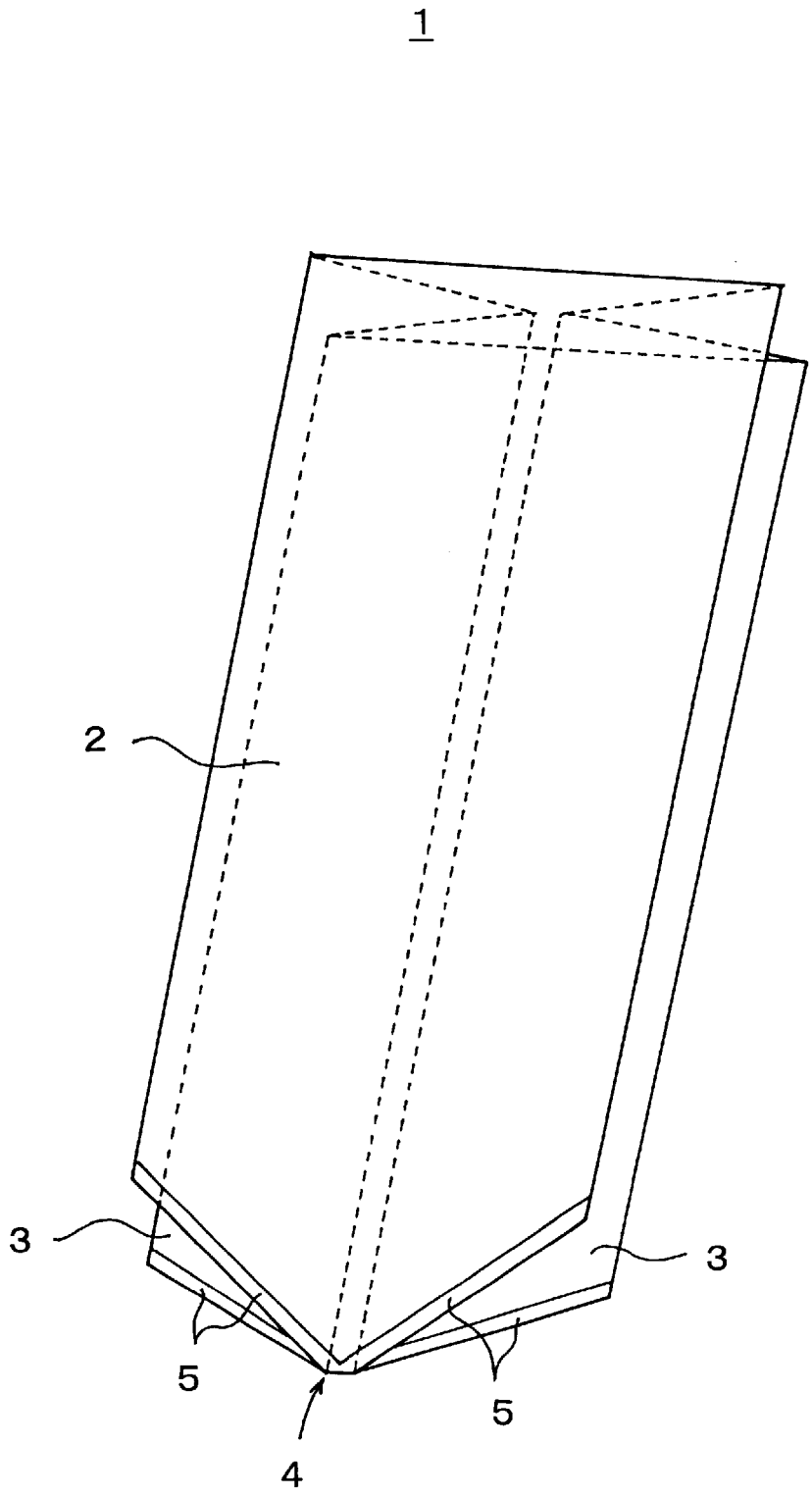
FIG. 3 is a perspective view illustrating the gusseted bag for medicinal or medical purposes of the first embodiment of the present invention under a collapsed condition.

FIG. 1 is a plan view illustrating a gusseted bag, a part of which is broken, for medicinal or medical purposes of the present invention. The gusseted bag 1 for medicinal or medical purposes of the present invention is composed of a pair of plane portions 2, 2 and a pair of gusset portions 3, 3 disposed under a folded condition between the plane portions 2, 2 so as to connect them. The adjacent edges of the plane portions 2, 2 and the gusset portions 3, 3 are joined with each other by means of a heat-sealing means (not shown) to form a gusseted bag body having a hollow and rectangular shape. The bottom of the gusseted bag body is heat-sealed in a K-shaped form 4 in the plan thereof so as to form two flap portions 6, 6, which locate outside the inclined heat-sealing portions 5, 5. The above-mentioned two flap portions 6, 6 are cut. The gusseted bag for medicinal or medical purposes of the present invention can be obtained in this manner. The plane portions 2, 2 and the gusset portions 3, 3 for the gusseted bag 1 are formed of the same plastic laminate 7.

The above-mentioned plastic laminate 7 is composed of a polyester film layer 8 having a thickness of 12 μm, a biaxial oriented nylon film layer 9 having a thickness of 15 μm, an ethylene-vinylalcohol copolymer film layer 10 having a thickness of 15 μm and a low-density polyethylene film layer 11 having a thickness of 75 μm. The low-density polyethylene film layer 11 is used as an innermost layer.

It is preferable to select, as the low-density polyethylene film layer 11, a polyethylene film layer having density within the range of from 0.910 to 0.919 that is so called "ultra low-density polyethylen film" layer. With the density of the polyethylene film layer of under 0.910, problems of the blocking and the like may easily occur. It is necessary to increase an amount of additives in order to prevent the occurrence of problems of the blocking and the like. Such an increased amount of additives may cause the additives contained in the low-density polyethylen film layer serving as a sealant layer of an inner bag to dissolve in chemicals received in the gusseted bag, after a long lapse of time or when gamma rays are irradiated on the inner bag in order to apply a sterilization treatment thereto. With the density of the polyethylene film layer of over 0.919, requirement of safety can be satisfied, whereas the rigidity of the film layer becomes so high that frictional contact of the film layer with the other object may easily cause the occurrence of a pin hole on the film layer.

The above-mentioned plastic laminate 7 may be composed only of the biaxial oriented nylon film layer 9 having a thickness of 15 μm and the low-density polyethylene film layer 11 having a thickness of 75 μm, depending on the use conditions.

According to the above-described plural layer structure of the plastic laminate 7, it is possible to supplement the function, which is excluded from the innermost layer 11 having no additive, with the functions of the other layers. The number of layers and the combination thereof may optionally be determined, so long as there is satisfied the requirement that the innermost layer 11 essentially contain no additive.

Figure 5:
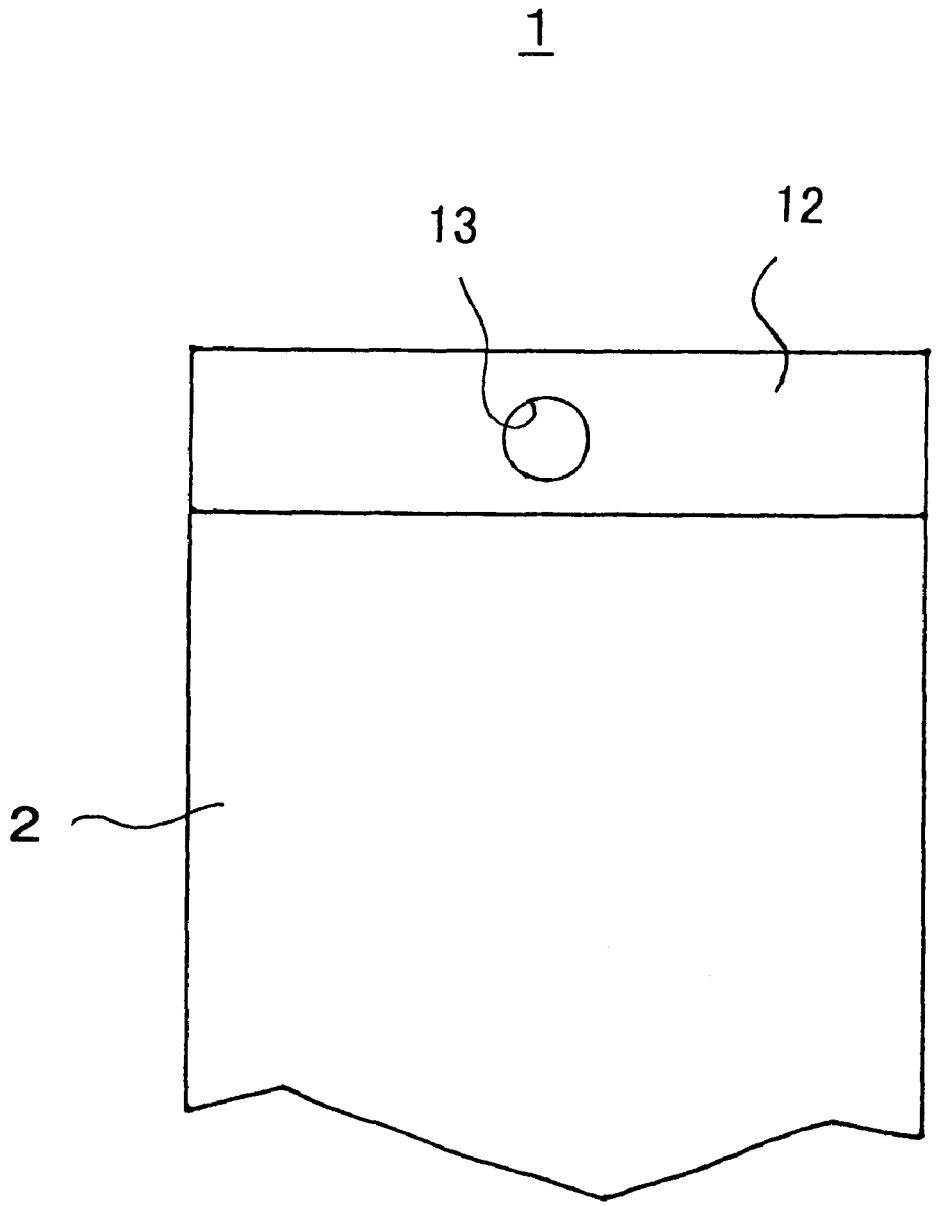
FIG. 5 is a partial plan view illustrating a hole for hanging the gusseted bag of the present invention.

When at least one hole 13 is formed, as shown in FIG. 5, on the upper portion of the gusseted bag 1 for medicinal or medical purposes of the present invention, it is possible to handle the gusseted bag 1 easily. In this case, it is preferable to form the hole 13 in a heat-sealed portion 12 as shown in FIG. 5 in view of improvement in strength. The heat-sealed portion 12 is formed by subjecting the upper portion of the gusseted bag body to a heat-sealing process.

Figure 4:
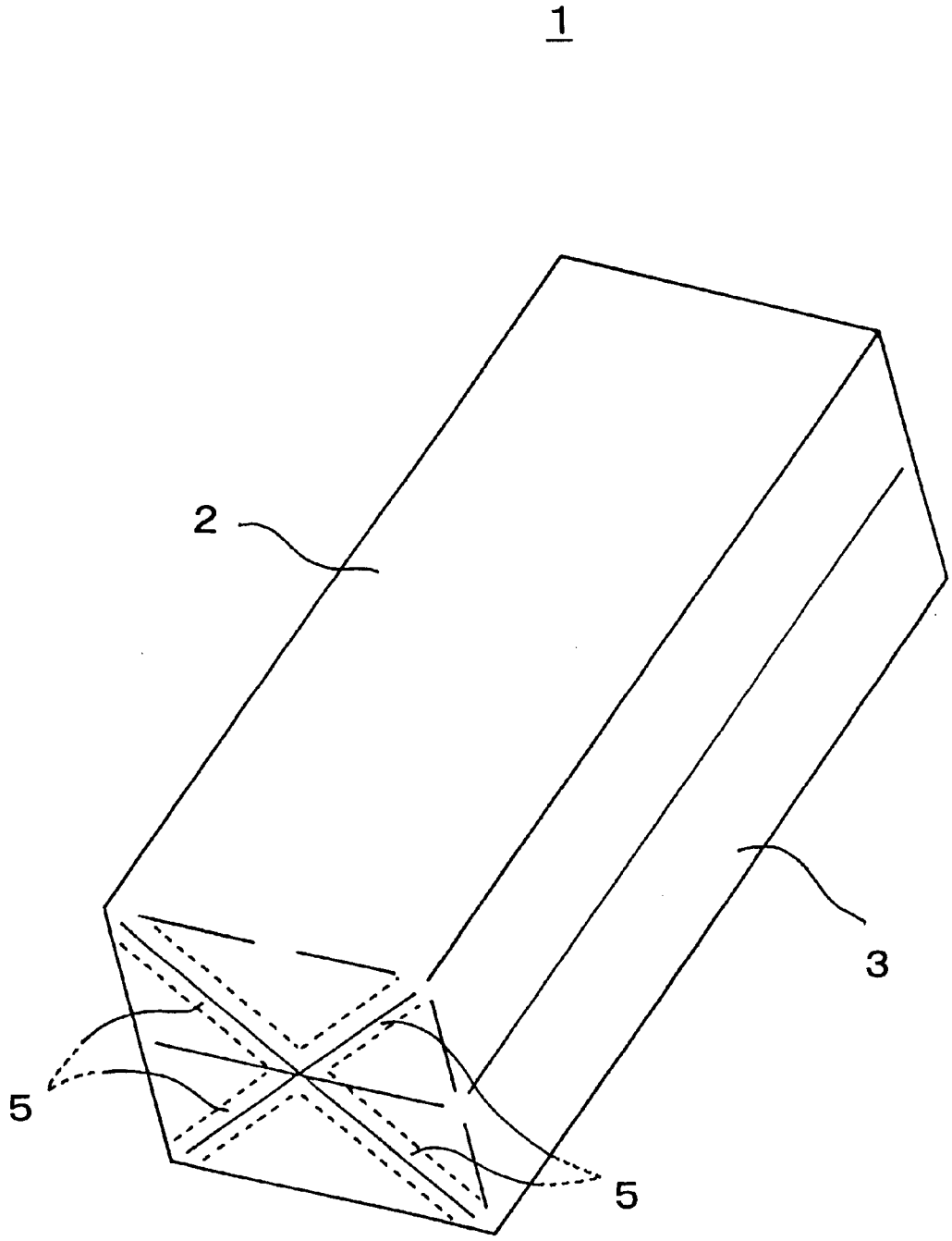
FIG. 4 is a perspective view illustrating the gusseted bag as shown in FIG. 3 under an expanded condition.

The gusseted bag 1 for medicinal or medical purposes of the present invention is used so as to be placed in a drum can or box-shaped container (not shown) and contents are received in the gusseted bag 1. The flap portions 6, 6, which locate outside the inclined heat-sealing portions 5, 5 as shown in FIG. 1 have already been cut during the manufacturing process of the gusseted bag 1. Accordingly, the bottom of the gusseted bag 1, which is placed under the expanded condition as shown in FIG. 4 in the drum can or box-shaped container, can appropriately be brought into contact closely and securely with the inner surface of the bottom of the drum can or box-shaped container. As a result, it is possible to prevent the occurrence of breakage of the gusseted bag even when it is subjected to medicinal processes and vibration caused by transportation. When the plastic laminate 7 has an excellent flexibility, the stress disperses and there occurs almost no concentration of stress with the result that there can be obtained the more preferable contact condition of the gusseted bag and the drum can or box-shaped container.

More specifically, the heat-sealing of the bottom of the gusseted bag body in the K-shaped form 4 in the plan thereof and the cutting of the flap portions 6, 6 permit a proper contact of the bottom of the gusseted bag 1 under the expanded condition with the bottom of the drum can or box-shaped container. Stress caused by the weight of contents received in the gusseted bag 1 and an impulsive force can appropriately be born by the walls of the drum can or box-shaped container, which serve as supporting members.

Figure 6:
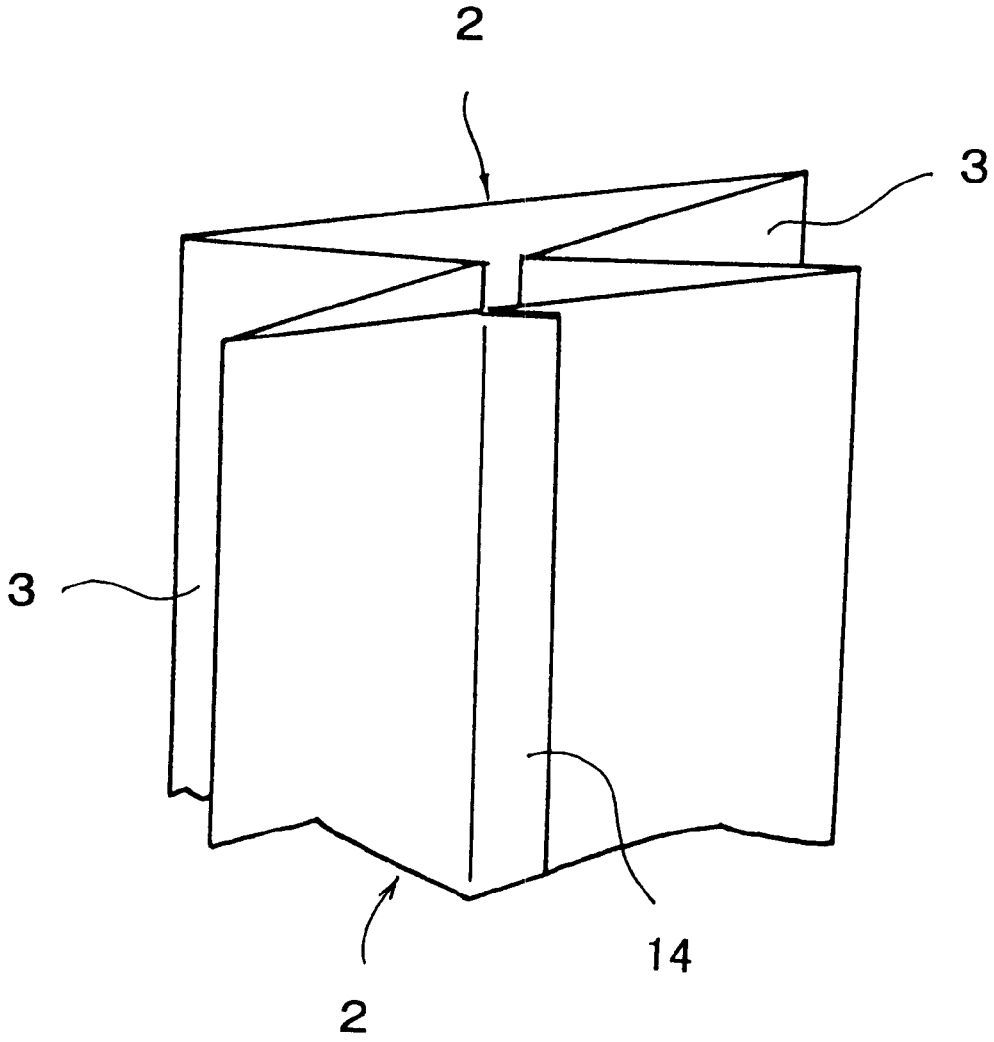
FIG. 6 is a partial perspective view illustrating a modification of a gusseted bag body.

In the above embodiment of the present invention, the gusseted bag body is described to be composed of the pair of plane portions 2, 2 and the pair of gusset portions 3, the adjacent edges of which are joined with each other by means of the heat-sealing means. The gusseted bag body may be obtained by heat-sealing the opposite side edges of the single rectangular sheet of the plastic laminate 7 to form a longitudinal heat-sealing portion 14 as shown in FIG. 6 so as to prepare a tubular body, and folding the opposite side portions of the thus prepared tubular body to form a pair of gusseted portions 3, 3. Such a method of preparing the gusseted bag body permits the number of heat-sealed portions thereof to be decreased, thus leading to an easy manufacture of the gusseted bag at a low cost.

According to the present invention as described in detail, a gusseted bag for medicinal or medical purposes of the present invention, which comprises a gusseted bag body formed of a plastic film into a hollow shape; and a sealed portion formed at a bottom of said gusseted bag body; is characterized in that: said plastic film is a laminate composed of a plurality of layers; and an innermost layer of said plurality of layers essentially consists of polyethylene. It is therefore possible to achieve a sufficient close contact condition of the bottom of the gusseted bag with the inner surface of the bottom of the drum can or box-shaped container and prevention of occurrence of breakage of the gusseted bag even under the influence of medicinal processes and vibration caused by transportation. The use of polyethylene having the density within the range of from 0.910 to 0.919 as the material for forming the innermost layer makes it possible to achieve almost no amount of additives, which are to be contained in the conventional polyethylene film layer. There can accordingly be avoided the problem of dissolution of additives in chemicals received in the gusseted bag, even when gamma rays are irradiated on the gusseted bag in order to apply a sterilization treatment thereto.

What is claimed is:

1. A gusseted bag for medicinal or medical purposes and to be subjected to a sterilization treatment by irradiation of gamma rays, the bag being adapted to be received in a container having a prescribed shape and comprising:

a gusseted bag body formed by converting a plastic film into a hollow shape;

a sealed portion formed at the bottom of said gusseted bag body by heat-sealing the bottom into a K-shaped form about a side plane of said gusseted bag body in a collapsed condition thereof so as to form two flap portions corresponding to corner portions of said gusseted bag body, and removing said two flap portions;

said plastic film comprising a laminate composed of a plurality of layers including a biaxially oriented nylon film layer;

the innermost layer of said plurality of layers consisting essentially of polyethylene having a density within a range from 0.910 to 0.919; and said laminate comprising, successively disposed, said innermost layer, an ethylene vinyl alcohol copolymer film layer, said biaxially-oriented nylon film layer, and a polyester film layer.

2. The gusseted bag as claimed in claim 1, wherein:

said gusseted bag body comprises at least one hole on an upper portion thereof for hanging said gusseted bag.

3. The gusseted bag as claimed in claim 1, wherein: said innermost layer has a thickness of about 75 $\mu$m, said ethylene-vinyl alcohol copolymer film layer has a thickness of about 15 $\mu$m, said biaxially-oriented nylon film layer has a thickness of about 15 $\mu$m, and said polyester film layer has a thickness of about 12 $\mu$m.

4. The gusseted bag as claimed in claim 2, wherein: said innermost layer has a thickness of about 75 $\mu$m, said ethylene-vinyl alcohol copolymer film layer has a thickness of about 15 $\mu$m, said biaxially-oriented nylon film layer has a thickness of about 15 $\mu$m, and said polyester film layer has a thickness of about 12 $\mu$m.

5. A gusseted bag for medicinal or medical purposes and to be subjected to a sterilization treatment by irradiation of gamma rays, the bag being adapted to be received in a container having a prescribed shape and consisting essentially of:

a gusseted bag body formed by converting a plastic film into a hollow shape;

a sealed portion formed at the bottom of said gusseted bag body by heat-sealing the bottom into a K-shaped form about a side plane of said gusseted bag body in a collapsed condition thereof so as to form two flap portions corresponding to corner portions of said gusseted bag body, and removing said two flap portions;

said plastic film comprising a laminate composed of a plurality of layers including a biaxially-oriented nylon film layer;

the innermost layer of said plurality of layers consisting essentially of polyethylene having a density within a range from 0.910 to 0.919; and said laminate comprising, successively disposed, said inner-most layer, an ethylene-vinyl alcohol copolymer film layer, said biaxially oriented nylon film layer, and a polyester film layer.

6. The gusseted bag as claimed in claim 5, wherein:

said innermost layer has a thickness of about 75 $\mu$m, said ethylene-vinyl alcohol copolymer film layer has a thickness of about 15 $\mu$m, said biaxially-oriented nylon film layer has a thickness of about 15 $\mu$m, and said polyester film layer has a thickness of about 12 $\mu$m.

7. The gusseted bag as claimed in claim 5, wherein:

said gusseted bag body comprises at least one hole on an upper portion thereof for hanging said gusseted bag.

* * * * *